US006356619B1

(12) United States Patent
Nagy et al.

(10) Patent No.: US 6,356,619 B1
(45) Date of Patent: Mar. 12, 2002

(54) VARYING X-RAY TUBE FOCAL SPOT DIMENSIONS TO NORMALIZE IMPACT TEMPERATURE

(75) Inventors: Paul G. Nagy, Greendale; Floribertus P. M. Heukensfeldt Jansen, Brookfield, both of WI (US)

(73) Assignee: General Electric Company, Waukesha, WI (US)

( * ) Notice: Subject to any disclaimer, the term of this patent is extended or adjusted under 35 U.S.C. 154(b) by 0 days.

(21) Appl. No.: 09/586,435

(22) Filed: Jun. 2, 2000

(51) Int. Cl.[7] ..... H01J 35/06; H01J 35/14
(52) U.S. Cl. ..... 378/138; 378/136
(58) Field of Search ..... 378/136, 137, 378/138, 125, 127; 313/341, 344, 346 R, 349

(56) References Cited

U.S. PATENT DOCUMENTS 1,902,502 A * 3/1933 Hofmann ..... 378/136
2,597,817 A * 5/1952 Poittevin ..... 378/136
3,631,289 A * 12/1971 Perry ..... 378/136
5,907,595 A * 5/1999 Sommerer ..... 378/136

* cited by examiner

*Primary Examiner*—David P. Porta
(74) *Attorney, Agent, or Firm*—Jenkens & Gilchrist

(57) ABSTRACT

In an X-ray tube having an anode supported for rotation and an annular target track mounted upon the anode, a cathode spaced apart from the anode projects a beam of electrons onto the target track within a focal spot. The cathode is designed to normalize the impact temperature across the focal spot, as a function of length. In accordance therewith, the cathode comprises a filament and a cathode cup, wherein the filament is disposed to project the electron beam onto the target track to generate X-rays, when a high voltage potential difference is established between the filament and the anode. The filament and the cathode cup are respectively configured to selectively form the electron beam so that the beam provides an electron distribution within the focal point which maintains each point within the focal spot at substantially the same temperature.

20 Claims, 6 Drawing Sheets

VARYING X-RAY TUBE FOCAL SPOT DIMENSIONS TO NORMALIZE IMPACT TEMPERATURE

BACKGROUND OF THE INVENTION

The invention disclosed and claimed herein generally pertains to design of the focusing cathode or filament geometry of a rotating anode X-ray tube. More particularly, the invention pertains to a cathode design that normalizes impact temperature along the focal spot length. Even more particularly, the invention pertains to a design of the above type which effectively varies the width of the X-ray tube focal spot, as a function of position along the length thereof, to normalize impact temperature over the focal spot length.

In a rotating anode X-ray tube, a beam of electrons is directed through a vacuum and across a very high voltage, on the order of 100 kilovolts, from a cathode to a focal spot position on an annular tungsten target track. X-rays are produced as electrons strike the focal spot on the target track, which is mounted on a disk-shaped anode rotated at high speed. However, the conversion efficiency of X-ray tubes is quite low, so that very little of the total power input, typically less than 1%, is converted to X-radiation. The remainder, in excess of 99% of the input electron beam power, is converted to thermal energy or heat. Accordingly, the effective management of heat is a major concern in X-ray tube design.

As used herein, the term "impact temperature" refers to the temperature of the target track within the focal spot, resulting from impacting electrons of the electron beam. In view of the thermal considerations referred to above, the impact temperature must not exceed the melting temperature of tungsten, at any point within the focal spot, to avoid damage to the target track. At present, this temperature constraint limits the maximum power that an X-ray tube can deliver in high current applications such as computed tomography (CT) and cine angiography. More particularly, if electric power applied to the cathode is increased, in order to increase electron emissions and thereby produce a higher output of X-rays, it may be necessary to enlarge the area of the focal spot. The increased number of impacting electrons are thereby spread over a greater area, to enhance cooling and maintain a specified level of loadability. (As used herein, loadability refers to the ability of the target track, within the focal spot, to tolerate a given quantity of heat.)

As is well known by those of skill in the art, while increasing focal spot size tends to improve loadability, such increase also reduces the quality of images produced by X-rays derived from the focal spot. Accordingly, the temperature limitation referred to above has, in the past, required a trade-off in the design of X-ray tubes. That is, increasing X-ray output could result in diminished image quality, and improvements in image quality could require reduced X-ray output.

SUMMARY OF THE INVENTION

The invention provides a method and apparatus for normalizing the impact temperature across an X-ray tube focal spot, as a function of length. In accordance therewith, the invention is directed to apparatus for producing X-rays which comprises an anode supported for rotation within the tube, an annular target track mounted upon the anode for rotation therewith, and a cathode spaced apart from the anode. The cathode comprises a filament and a cathode cup, which cooperatively project a beam of electrons onto the target track, within the focal spot, to generate X-rays. The filament and cathode cup are respectively configured to selectively form the electron beam so that the beam provides an electron distribution within the focal point which maintains each point within the focal spot at substantially the same temperature.

In a preferred embodiment, the filament has an associated axis and the focal spot has length and width dimensions. The length dimension is measured between two focal spot end points along a direction which is parallel to the axis, and the width dimension is measured along a direction which is orthogonal to the filament axis and the length direction. The filament and cathode cup are respectively configured to form the beam so that the beam defines a focal spot having width dimensions at its end points which are substantially less than the focal spot width at a location midway between the two end points. Preferably also, the target track comprises tungsten, the anode comprises a rotatable disk formed of a refractory metal, and a potential difference on the order of 100 kilovolts is maintained between the cathode and the anode to produce X-rays.

In a useful embodiment, the cathode cup is provided with a planar surface having a channel formed therein, and the filament comprises a helical filament disposed for insertion into the channel, the helical filament having a central portion and opposing end portions. The filament is selectively curved, so that its end portions are recessed deeper into the channel than the central portion thereof, relative to the planar surface of the cup.

In another useful embodiment, the filament comprises a linear helical filament having a central portion and opposing end portions. The cathode cup is provided with a selectively curved surface having a channel formed therein, the filament being inserted into the channel so that the opposing end portions of the filament are recessed further into the channel than the central portion thereof, as a result of the curvature of the cup.

DETAILED DESCRIPTION OF THE PREFERRED EMBODIMENT

Figure 1:
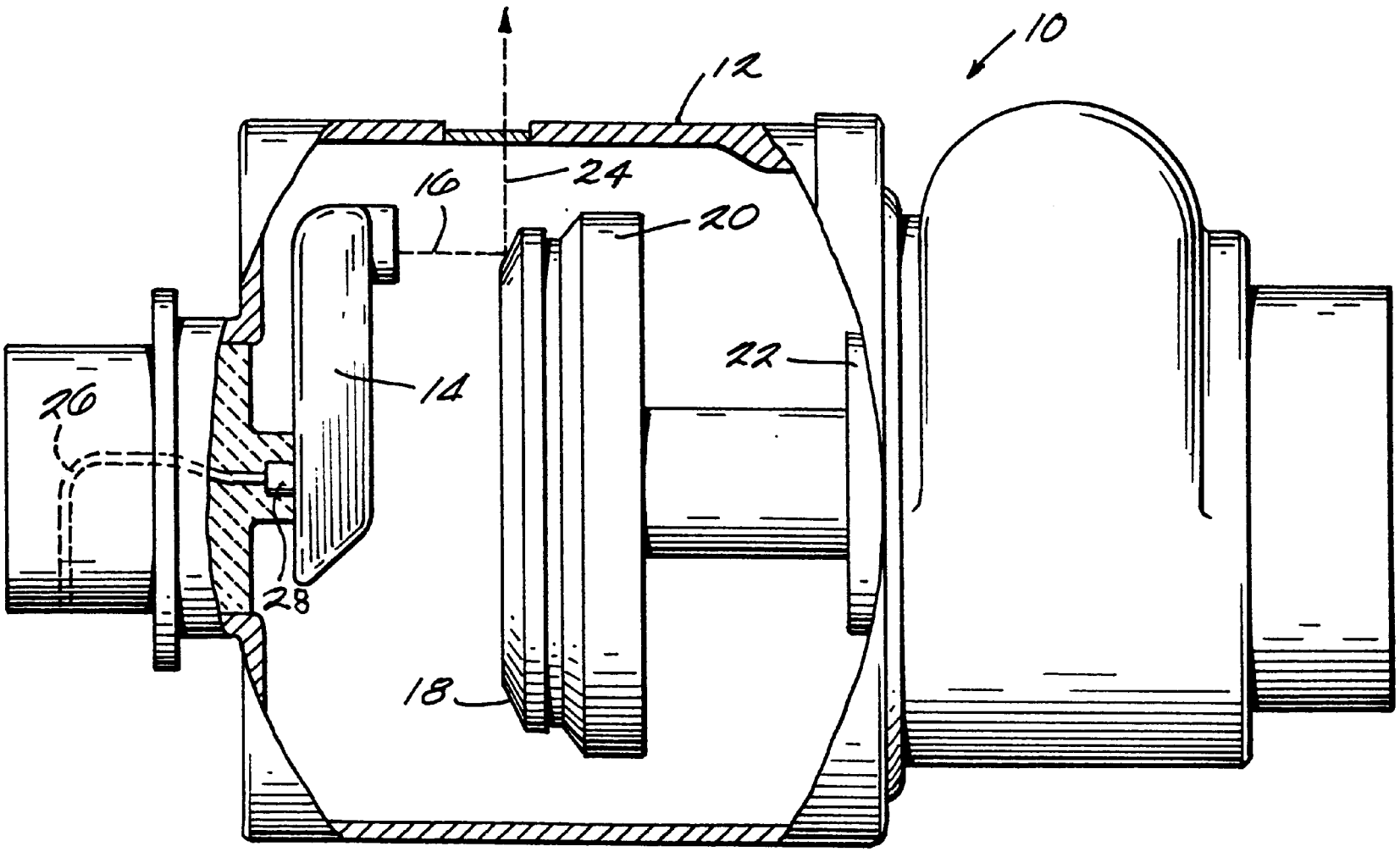
FIG. 1 is a perspective view with a section broken away, showing an X-ray tube which may employ an embodiment of the invention.

Referring to FIG. 1, there is shown an X-ray tube 10. In accordance with conventional practice, tube 10 generally includes a metal housing 12 which supports other X-ray tube components including a cathode 14, and also provides a protective vacuum enclosure therefor. Cathode 14 directs a high energy stream of electrons 16 onto a target track 18 of an anode 20, which consists of a refractory metal disk, or alternatively a graphite disk, and is continually rotated by means of a conventional mounting and drive mechanism 22. Target track 18 has an annular or ring-shaped configuration and typically comprises a tungsten based alloy integrally bonded to the anode disk 20, or may comprise tungsten-rhenium if anode 20 is formed of graphite. As anode 20 rotates, the stream of electrons from cathode 14 impinges upon a continually changing portion of target track 18 to generate X-rays, at a focal spot position. A beam of X-rays 24 generated thereby is projected from the anode focal spot through an X-ray transmissive window provided in the side of housing 12.

In order to produce X-rays as described above, there must be a potential difference on the order of 100 kilovolts between cathode 14 and anode 20, to accelerate the electrons in the space therebetween. In a common arrangement, this is achieved by coupling the anode to a ground connection (not shown), and applying power at the required 100 kilovolt range to cathode 14 through an electric cable 26 and a cathode coupling 28.

Figure 2:
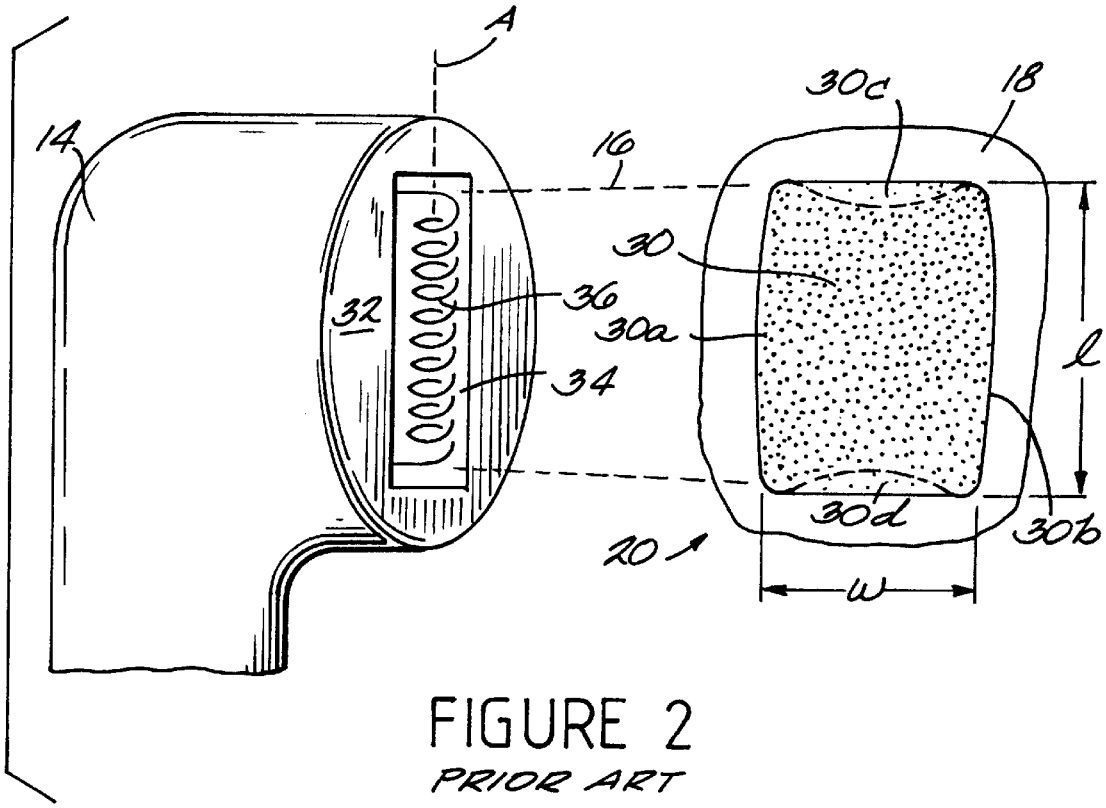
FIGURE 2 PRIOR ART
FIG. 2 is a perspective view showing prior art components which may be employed in the X-ray tube of FIG. 1 in further detail.

Referring to FIG. 2, there is shown a cathode 14 constructed in accordance with the prior art. Such cathode has a cup provided with a surface 32, having a slot or channel 34 formed therein. An elongated helical filament 36, extending along an axis A, is placed within channel 34 and emits the electrons of a beam 16 when electric power is applied to the cathode as described above. The electrons are accelerated through the vacuum space between cathode 14 and anode 20, by the 100 kilovolt potential difference, and impact the target track 18 of the anode within a focal spot 30. While the tungsten target track is continually rotating, the boundaries of the focal spot are fixed, and are defined by the electron beam.

Referring further to FIG. 2, there is shown focal spot 30 having a length dimension l measured along a direction which is parallel to filament axis A, and a width dimension w which is measured along a direction orthogonal to the direction of the length measurement. The length l of the focal spot is determined by and is substantially equal to the length of filament 36. The width of the focal spot, at a particular position along the length thereof, is determined by the extent to which electrons emitted by a corresponding portion of filament 36 spread outward therefrom, between the filament and the target track. FIG. 2 shows that electron distribution is greater along the sides 30*a* and 30*b* of focal spot 30 than along the center thereof.

Figure 3:
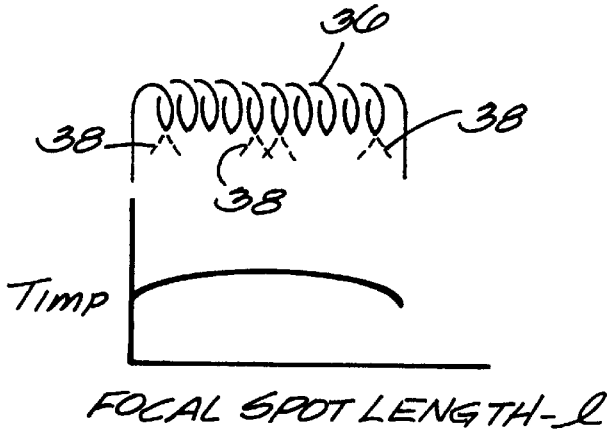
FIGURE 3 PRIOR ART
FIG. 3 is a graph showing the relationship between temperature and length of the focal spot depicted in FIG. 2.

Referring to FIG. 3, there is shown a graph depicting variation of focal spot impact temperature $T_{imp}$ over the length of the focal spot 30. More particularly, FIG. 3 shows that the temperature of the focal spot is substantially lower at its ends than in its center. As illustrated by filament 36 placed above the graph of FIG. 3, the temperature of the coils along the central portion of the filament is greater than the temperature at the two ends thereof. Electron emission increases rapidly with temperature. Moreover, locations along the central portion of focal spot 30 receive electron emissions 38 from many more filament coils than locations proximate to the ends of the focal spot. Accordingly, electron density is greater along the corresponding central portion of focal spot 30 than at the ends thereof. This is also illustrated in FIG. 2, wherein end regions 30*c* and 30*d* are shown to have lower electron densities than other regions of focal spot 30. The lower electrons densities in turn result in lower impact temperatures at the ends of the focal spot.

In accordance with the invention, it has been recognized that the condition depicted in FIG. 3 enables certain adaptations of the focal spot, which can provide significant benefits in X-ray tube operation. More specifically, it has been recognized that the cathode may be designed to provide a focal spot having the configuration of focal spot 40, shown in FIG. 4, rather than the configuration of conventional focal spot 30. Focal spot 40 is widest at its central region 40*a*, and tapers therefrom to its two ends 40*b* and 40*c*, which are both of substantially less width than the central region 40*a*. The overall area of focal spot 40 is significantly reduced, by reducing the width of focal spot 40 at its two ends, whereby electron density is more uniformly distributed over the width of the focal spot, and the image quality of X-rays produced from the focal spot 40 is substantially improved. Reducing the area of focal spot 40 proximate to its end regions 40*b* and 40*c* will, of course, raise the temperature of such regions, since there will be less area for distributing the heat of electrons impacting thereupon. This is acceptable, however, since the focal spot temperature at its end regions was lower to begin with, as described above in connection with FIG. 3. It is only necessary to ensure that the end region temperatures do not exceed a maximum allowable temperature for the tungsten target track. Generally, it would be desirable to vary the width of the focal spot along its length to normalize impact temperature with respect to length, i.e., to have substantially the same temperature at each point along the focal spot length.

Figure 5:
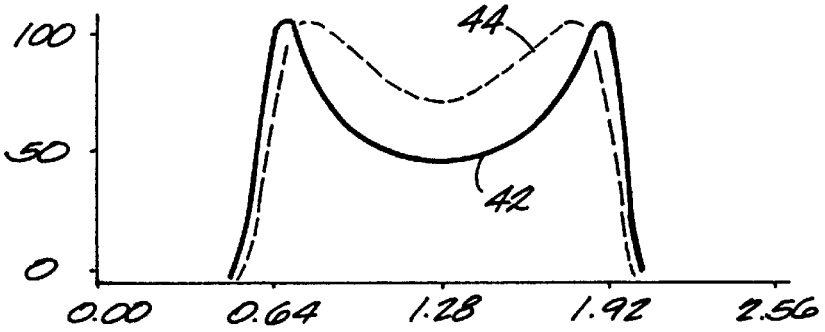
FIG. 5 is a graph which compares parameters associated with the focal spots of FIG. 2 and FIG. 4, respectively.

Referring to FIG. 5, there are shown curves 42 and 44 depicting X-ray density over width, for X-rays produced by the electrons impacting focal spots 30 and 40, respectively. Each curve was generated by integrating the X-ray density of its corresponding focal spot over length, at each point along the focal width. Curve 42 indicates that X-rays are concentrated along the sides of focal spot 30. In contrast, curve 44 indicates that X-rays produced in connection with focal spot 40 are much more uniformly distributed across the width thereof. This enhances the quality of images acquired by the X-rays of focal spot 40, as stated above.

Figure 4:
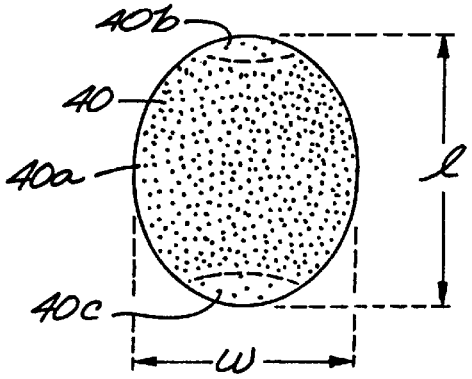
FIG. 4 shows an X-ray tube focal spot provided by an embodiment of the invention.
Figure 6:
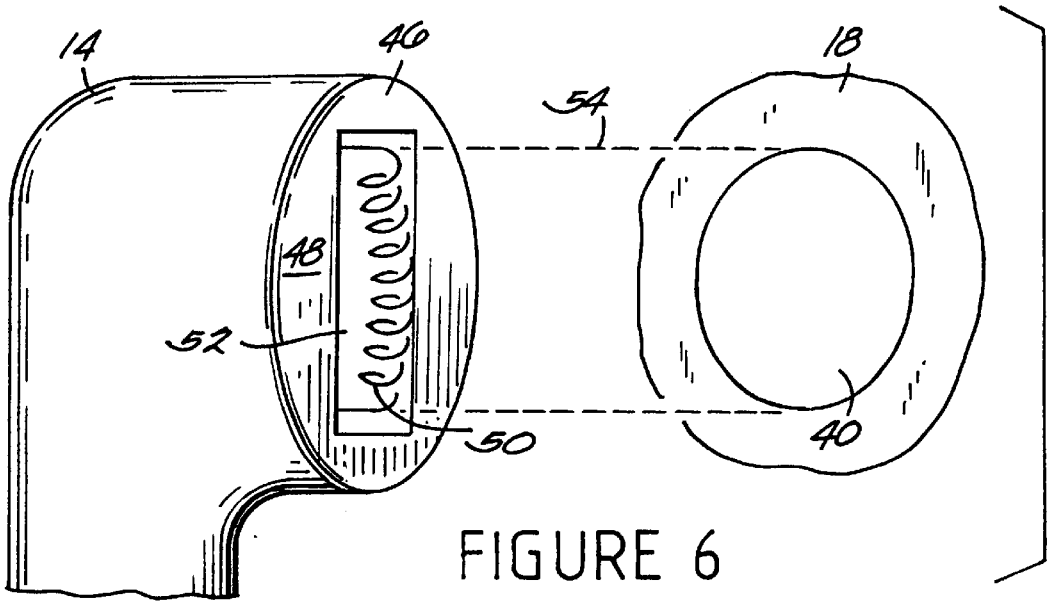
FIG. 6 is a perspective view showing a cathode constructed in accordance with an embodiment of the invention.

Referring to FIG. 6, there is shown cathode 14 adapted to generate a focal spot having the configuration of focal spot 40. Cathode 14 is provided with a cup or cup-shaped structure 46 at its forward end having a planar surface 48 and a slot or channel 52 formed therein. A helical filament 50 is inserted into channel 52, to project an electron 54 onto target track 18 when energized by a high voltage electric current. The electrons impact track 18 within boundaries defining focal spot 40, as shown in FIG. 4.

Figure 7:
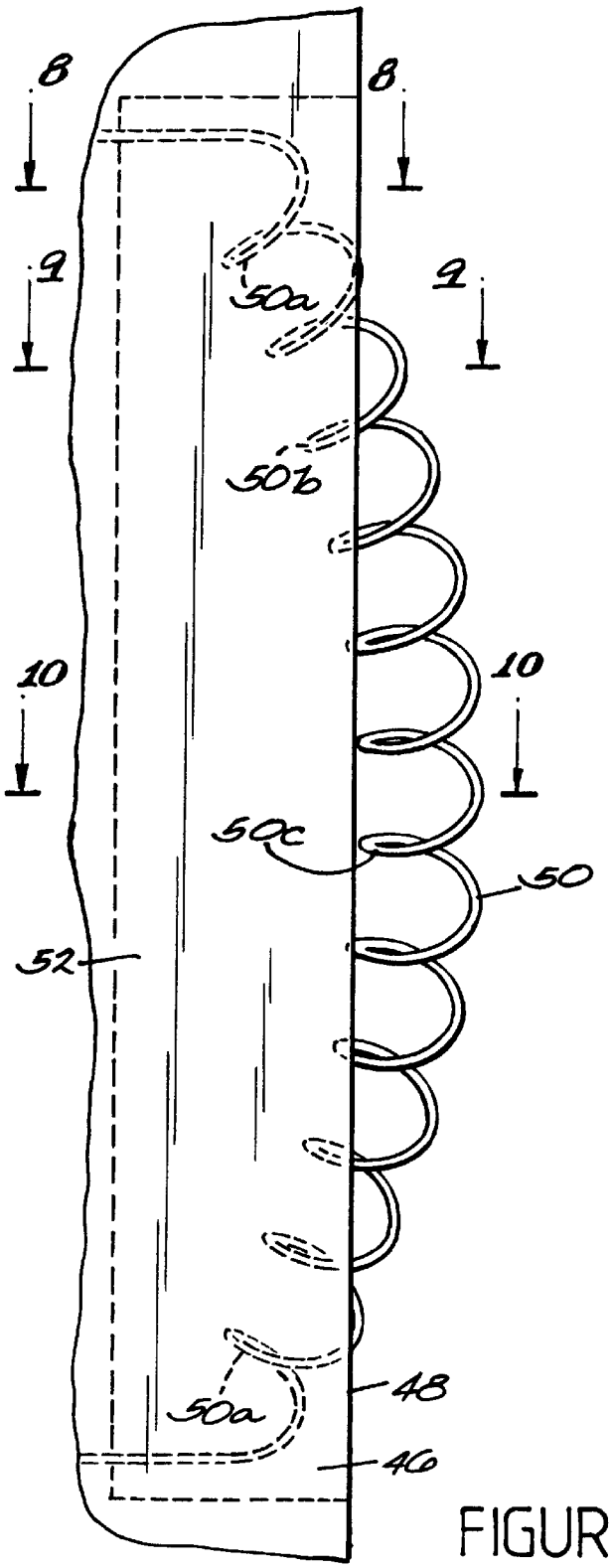
FIG. 7 is a sectional view showing a portion of FIG. 6 in greater detail.

As best shown by FIG. 7, filament 50 is selectively curved, so that the end portions or segments 50*a* thereof are set more deeply into channel 52 than other portions thereof. Intermediate portion 50*b* of filament 50 is proximate to planar surface 48 of cup 46, and central filament portion 50*c* is positioned above surface 48. Thus, the set heights of respective portions or segments of filament 50 gradually increase from the ends thereof to the center thereof, wherein set height indicates the level of a filament portion with respect to the cup surface 48.

Figure 8:
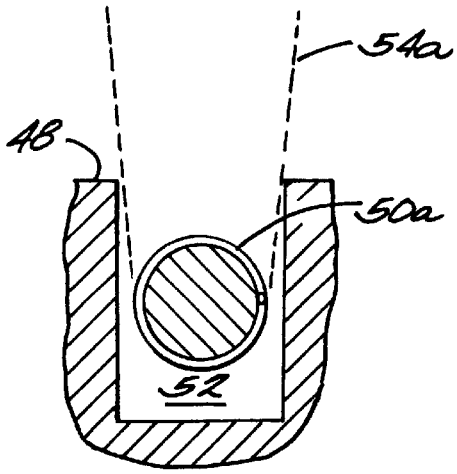
FIGS. 8, 9 and 10 are sectional views taken along lines 8—8, 9—9, and 10—10, respectively, of FIG. 7.
Figure 9:
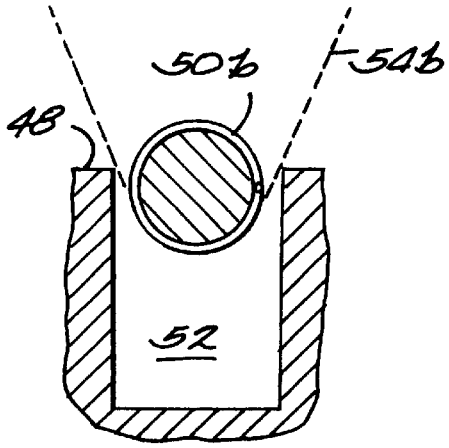
Figure 10:
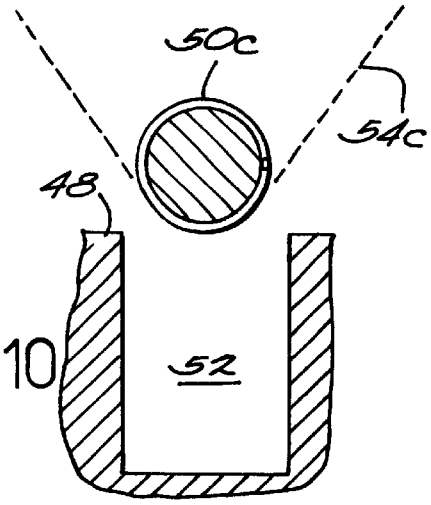
Figure 11:
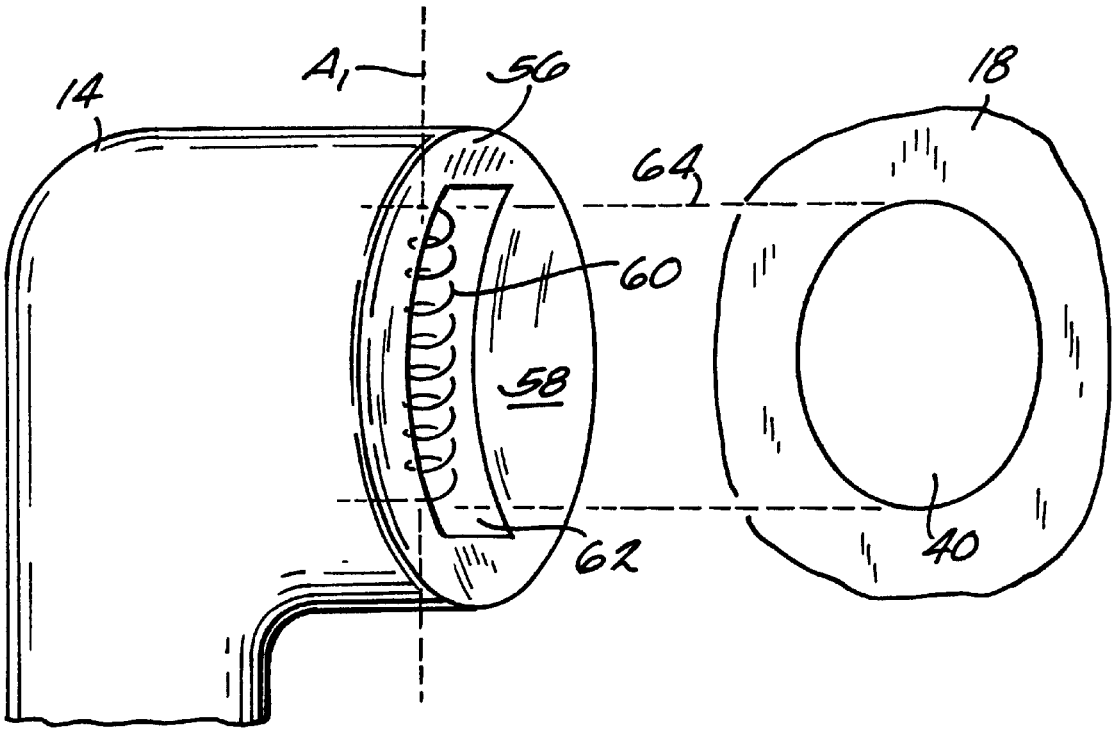
FIG. 11 is a perspective view showing a cathode constructed in accordance with a second embodiment of the invention.
Figure 12:
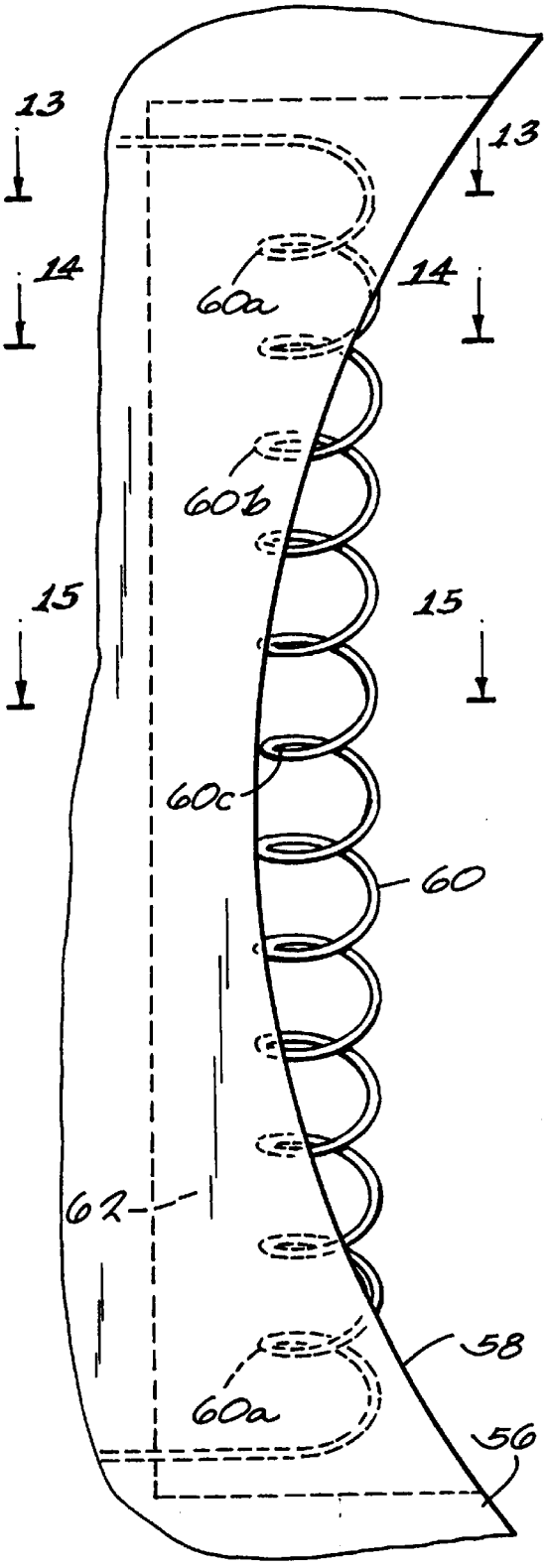
FIG. 12 is a sectional view showing the embodiment of FIG. 11 in greater detail.
Figure 13:
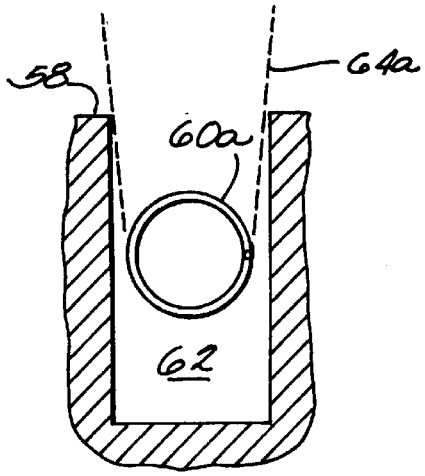
FIGS. 13, 14 and 15 are sectional views taken along lines 13—13, 14—14 and 15—15, respectively, of FIG. 12.
Figure 14:
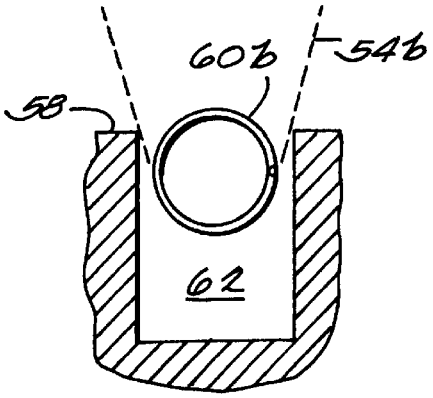
Figure 15:
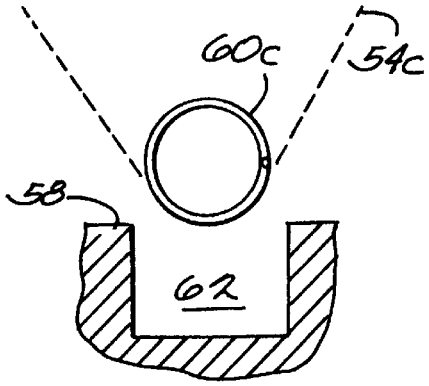

Referring to FIG. 8, it is seen that because end portions 50*a* of filament 50 are recessed deeply into channel 52, the width of the beam portions 54*a* produced thereby are narrowed by the walls of channel 52. Thus, the beam portions 54*a* provide focal spot 40 with reduced width at its end regions 40*b* and 40*c*. Referring to FIGS. 9 and 10, it is seen that as set height of the filament portions is increased, the widths of the beam portions respectively produced thereby are likewise increased. Accordingly, the width of beam portion 54*b*, produced by intermediate filament portion 50*b*, is greater than the width of beam portion 54*a*, and beam portion 54*c*, produced by central filament portion 50*c* has the greatest width. Thus, curved filament 50 and cup 46 cooperate to generate focal spot 40, which is widest at its center and tapers to its ends, as described above. It is to be noted that as the filament set height in the cup is reduced, the emission will decrease. However, around the typical operating point of cathodes with helical filaments the loss of emission is less than the reduction in width, so that there is an overall gain. It is to be noted further that since set height of a filament portion determines the width and electron density of a corresponding position or region of the focal spot, the set height also determines focal spot impact temperature at such region. Referring to FIG. 11, there is shown an alternative embodiment of the invention, wherein cathode 14 is provided with a cup 56 having a curved surface 58 and a channel 62 formed therein. A linear helical filament 60, having its coils oriented along an axis $A_1$, is inserted into channel 62 of cup 58 to project an electron beam 64 onto target track 18, within a focal spot 40. As best shown by FIG. 12, the curved surface 58 of the cup results in the set heights of filament 60, with respect to channel 62, progressively increasing from the filament end portions 60*a* to the central filament portion 60*c*. In like manner with filament 50 described above, and as shown by FIGS. 13–15, as the set height of respective filament portions is increased, the widths of the beam portions respectively produced thereby are likewise increased. Accordingly, the width of beam portion 64*b*, produced by intermediate filament portion 60*b*, is greater than the widths of beam portions 64*a*, produced by end filament portions 60*a*, and beam portion 64*c*, produced by central filament portion 60*c*, has the greatest width.

In order to provide cathode and filament geometries for the embodiments disclosed above, to generate focal spot 40, it is to be understood that electron emission and impact temperature can be normalized along the anode-cathode axis by altering focal spot width as a function of position along the length of the focal spot. Thermal analysis indicates that impact temperature is proportional to the inverse of the square root of focal spot width when peak current density is constant. Accordingly, the cathode and filament should be designed to provide a focal spot 40 having a width that decreases along the length of the focal spot, from the center to the ends thereof, wherein width at a given point along the length is proportional to the square root of the current density at the given point.

While the above embodiments have been directed to cathodes with helical filaments, other embodiments of the invention may employ other types of filaments, including flat filaments and circular filaments. In yet other embodiments of the invention, instead of decreasing focal spot size to improve image quality, electron emission may be increased to increase X-ray output. It is anticipated that an embodiment of the invention can increase X-ray output on the order of 11%, for a focal spot size of 1.0 millimeters, while maintaining constant resolution and maximum impact temperature, which is normalized along the focal spot length. It will be understood that X-ray output is a function of focal spot size, and increases with focal spot size.

Obviously, many modifications and variations of the present invention are possible in light of the above teachings. It is therefore to be understood that within the scope of the disclosed concept, the invention may be practiced otherwise than as has been specifically described.

What is claimed is:

1. In an X-ray tube, apparatus for producing X-rays comprising:

an anode supported for rotation within said tube;

an annular target track mounted upon said anode for rotation therewith;

a cathode spaced apart from said anode, said cathode comprising a filament and a cathode cup disposed to cooperatively project a beam of electrons onto said target track within a focal spot to generate X-rays; and said filament and cathode cup are respectively configured to form said beam so that said beam provides an electron distribution within said focal spot which maintains each point therein at substantially the same temperature.

2. The apparatus of claim 1 wherein:

said filament has an associated axis, and said focal spot has length and width dimensions, said length dimension being measured between two focal spot end points along a direction parallel to said filament axis, and said width dimension being measured along a direction orthogonal to said length direction; and said filament and said cathode cup are respectively configured to form said beam to define a focal spot having width dimensions at said end points which are substantially less than the width dimension of said focal spot at a location which is midway between said end points.

3. The apparatus of claim 1 wherein:

said cathode cup is provided with a planar surface having a channel formed therein; and said filament comprises an elongated helical filament disposed for insertion into said channel, said helical filament having a central portion and opposing end portions, said helical filament being selectively curved so that said opposing end portions are recessed further into said channel than said central portion thereof, with respect to said planar surface.

4. The apparatus of claim 1 wherein:

said filament comprises a linear helical filament extending along an axis, said helical filament having a central portion and opposing end portions; and said cathode cup is provided with a selectively curved surface having a channel formed therein, said helical filament being inserted into said channel so that said opposing end portions are recessed further into said channel than said central portion thereof.

5. The apparatus of claim 1 wherein:

said anode comprises a rotatable disk formed of a refractory metal and said target track comprises tungsten.

6. The apparatus of claim 5 wherein:

said X-ray tube provides a vacuum enclosure for said anode and said cathode, and a potential difference on the order of 100 kilovolts is maintained therebetween to produce X-rays.

7. The apparatus of claim 1 wherein:

said anode comprises a rotatable disk formed of graphite and said target track comprises tungsten-rhenium.

8. In an X-ray tube having a rotary anode provided with an annular target track, cathode apparatus disposed to project a beam of electrons onto said target track within a focal spot to generate X-rays, said cathode apparatus comprising:

a cathode cup provided with a surface of selected configuration having a channel formed therein; and a filament fixably mounted within said channel for projecting said electron beam, said filament and cathode cup being respectively configured to form said beam so that said beam provides an electron distribution within said focal spot which maintains each point therein at substantially the same specified impact temperature.

9. The apparatus of claim 8 wherein:

each portion of said filament has a set height with respect to said cathode cup surface which determines the impact temperature of a corresponding region of said focal spot, the respective set heights of all said filament portions being selected so that the impact temperature at all regions of said focal spot is substantially equal to said specified impact temperature.

10. The apparatus of claim 9 wherein:

said filament is disposed to project said electron beam within a focal spot having a central region and two end regions on opposing sides of said central region, wherein the width of said central region is greater than the widths of said end regions, and said focal spot is configured to taper from said central region to each of said end regions.

11. The apparatus of claim 9 wherein:

said cathode cup is provided with a planar surface having a channel formed therein; and said filament comprises an elongated helical filament inserted into said channel, said helical filament having a central portion and opposing end portions, said helical filament being selectively curved so that said opposing end portions are recessed further into said channel than said central portion thereof, with respect to said planar surface.

12. The apparatus of claim 9 wherein:

said filament comprises a linear helical filament extending along an axis, said helical filament having a central portion and opposing end portions; and said cathode cup is provided with a selectively curved surface having a channel formed therein, said helical filament being inserted into said channel so that said opposing end portions are recessed further into said channel than said central portion thereof.

13. The apparatus of claim 9 wherein:

said specified impact temperature is selectively less than the melting point of tungsten.

14. A method of producing X-rays comprising the steps of:

placing a cathode filament along a channel formed in the surface of a cathode cup so that the set heights of respective segments of said filament are selectively varied along the length of said channel;

fixably mounting said filament and cathode cup in an X-ray tube, in selected spaced-apart relationship with a rotatable anode provided with an annular target track; and establishing a potential difference of specified voltage between said filament and said anode, as said anode is rotated, to operate said filament to project a beam of electrons onto said target track within a focal spot to generate X-rays, the electron distribution within said focal spot being determined by said set height variations, said set height variations being selected so that each point within said focal spot is maintained at substantially the same specified impact temperature.

15. The method of claim 14 wherein:

said cathode cup is provided with a planar surface, said channel being formed therein;

said filament comprises an elongated helical filament inserted into said channel, said helical filament having a central portion and opposing end portions; and said filament placement step comprises selectively curving said filament so that said opposing end portions are recessed further into said channel than said central portion thereof, with respect to said planar surface.

16. The method of claim 14 wherein:

said filament comprises a linear helical filament extending along an axis, said helical filament having a central portion and opposing end portions;

said cathode cup is provided with a selectively curved surface having a channel formed therein; and said filament placement step comprises inserting said helical filament into said channel so that said opposing end portions are recessed further into said channel than said central portion thereof.

17. The method of claim 14 wherein:

said anode comprises a rotatable disk formed of a refractory metal and said target track comprises tungsten.

18. The method of claim 17 wherein:

said potential difference is on the order of 100 kilovolts.

19. The method of claim 18 wherein:

said specified impact temperature is selectively less than the melting point of tungsten.

20. The method of claim 14 wherein:

said anode comprises a rotatable disk formed of graphite and said target track comprises tungsten-rhenium.

* * * * *